US009322200B1

(12) United States Patent
Shimizu

(10) Patent No.: US 9,322,200 B1
(45) Date of Patent: Apr. 26, 2016

(54) OUTER HANDLE DEVICE FOR VEHICLE DOOR

(71) Applicant: KABUSHIKI KAISHA HONDA LOCK, Miyazaki-shi, Miyazaki (JP)

(72) Inventor: Norio Shimizu, Miyazaki (JP)

(73) Assignee: KABUSHIKI KAISHA HONDA LOCK, Miyazaki (JP)

( * ) Notice: Subject to any disclaimer, the term of this patent is extended or adjusted under 35 U.S.C. 154(b) by 0 days.

(21) Appl. No.: 14/822,475

(22) Filed: Aug. 10, 2015

(30) Foreign Application Priority Data

Oct. 28, 2014 (JP) ..... 2014-218992

(51) Int. Cl.
*E05B 13/00* (2006.01)
*E05B 85/16* (2014.01)
*E05B 79/10* (2014.01)

(52) U.S. Cl.
CPC ..... *E05B 85/16* (2013.01); *E05B 79/10* (2013.01); *Y10T 70/577* (2015.04); *Y10T 70/5761* (2015.04)

(58) Field of Classification Search
CPC ..... E05B 79/10; E05B 85/16; Y10T 70/577; Y10T 70/5761
USPC ..... 70/208, 210, 370, 451; 292/336.3, 292/DIG. 31
See application file for complete search history.

(56) References Cited

U.S. PATENT DOCUMENTS

| | | | | |
|---|---|---|---|---|
| 7,931,314 | B2 * | 4/2011 | Nitawaki | B60R 25/246 292/336.3 |
| 2003/0122556 | A1 * | 7/2003 | Sueyoshi | B60R 25/246 324/686 |
| 2013/0233034 | A1 * | 9/2013 | Ono | E05B 79/06 70/101 |
| 2014/0117683 | A1 * | 5/2014 | Saitou | E05B 79/06 292/336.3 |
| 2014/0203574 | A1 * | 7/2014 | Noda | E05B 81/77 292/336.3 |
| 2015/0096339 | A1 * | 4/2015 | Behnke | E05B 85/06 70/237 |
| 2015/0167362 | A1 * | 6/2015 | Kang | E05B 85/16 292/336.3 |

FOREIGN PATENT DOCUMENTS

| | | |
|---|---|---|
| JP | 4552325 | 9/2010 |

* cited by examiner

*Primary Examiner* — Lloyd Gall
(74) *Attorney, Agent, or Firm* — Rankin, Hill & Clark LLP

(57) ABSTRACT

An outer handle device for a vehicle door includes: a latch mechanism; an outer handle having a grip and a coupling arm that is consecutively provided at the other end of the grip and is coupled to the latch mechanism; a base member that is made of a synthetic resin and arranged on the outer side of the outer panel; a metallic reinforcing plate that is interposed between the base member and an outer surface of the outer panel; a cylinder lock configured to switch between locked and unlocked states of the vehicle door, that is disposed in the base member; and a receiving portion that is provided in the reinforcing plate and abuts against the coupling arm during a turning operation of the outer handle to an opening side of the vehicle door to restrict a turning end of the outer handle.

5 Claims, 3 Drawing Sheets

OUTER HANDLE DEVICE FOR VEHICLE DOOR

CROSS-REFERENCE TO RELATED APPLICATION

This application claims priority from Japanese Patent Application No. 2014-218992 filed with the Japan Patent Office on Oct. 28, 2014, the entire content of which is hereby incorporated by reference.

BACKGROUND

1. Technical Field

An embodiment of the present disclosure relates to an outer handle device for a vehicle door.

2. Description of the Related Art

In a known outer handle device for a vehicle door that is disclosed in Japanese Patent No. 4552325, a base member is fixed to an outer panel. A cylinder lock is disposed in this base member.

SUMMARY

An outer handle device for a vehicle door includes: a latch mechanism; an outer handle having a grip that is arranged on an outer side of an outer panel of a vehicle door and has one end turnably supported by the outer panel, and a coupling arm that is consecutively provided at the other end of the grip and is coupled to the latch mechanism; a base member that is made of a synthetic resin and arranged on the outer side of the outer panel; a metallic reinforcing plate that is interposed between the base member and an outer surface of the outer panel; a cylinder lock configured to switch between locked and unlocked states of the vehicle door, that has a cylinder body fastened to the outer panel by joint fastening with the reinforcing plate and the base member and is disposed in the base member; and a receiving portion that is provided in the reinforcing plate and abuts against the coupling arm during a turning operation of the outer handle to an opening side of the vehicle door to restrict a turning end of the outer handle.

DESCRIPTION OF THE EMBODIMENTS

Figure 1:
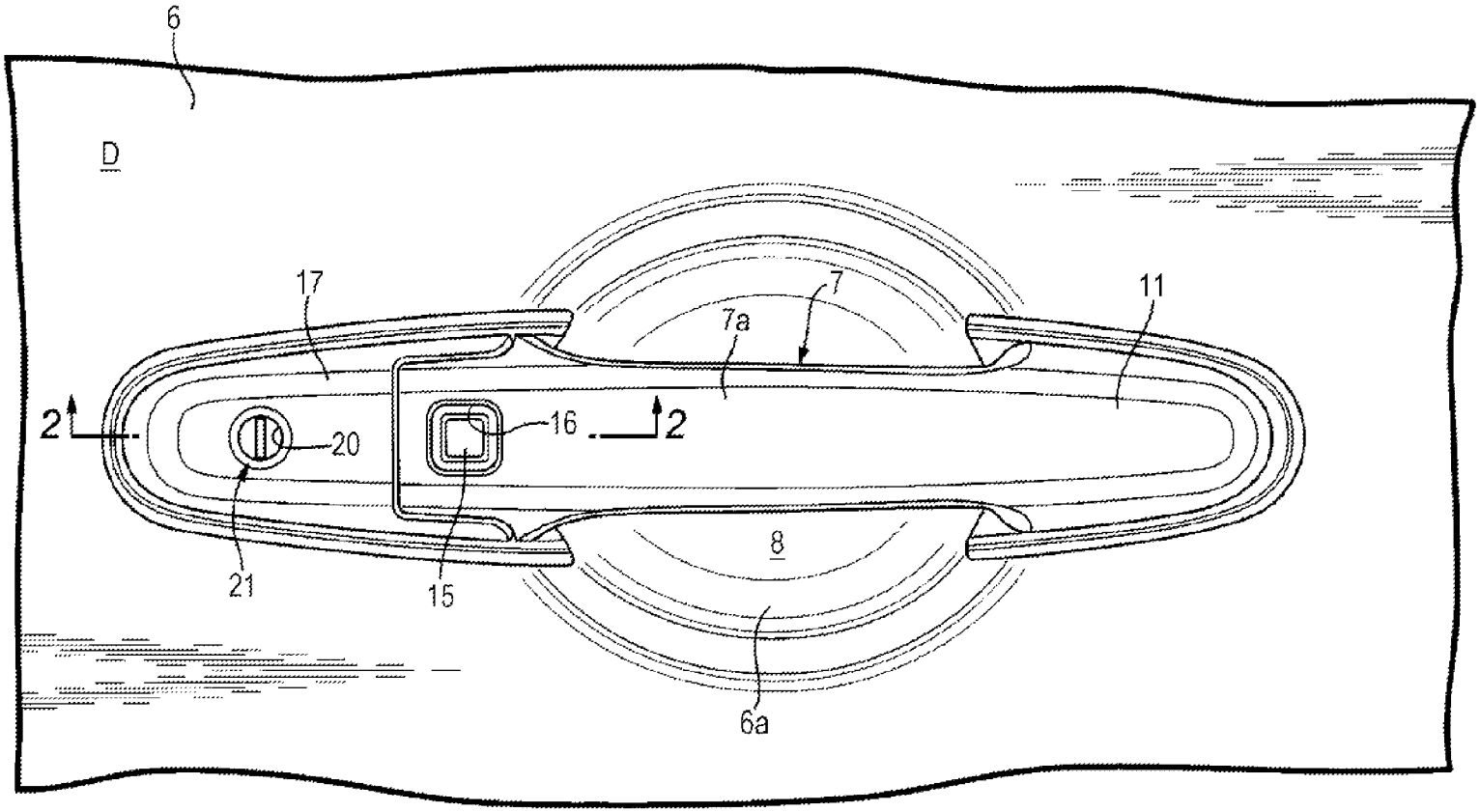
FIG. 1 is a partial side view of a vehicle door.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In order to restrict a turning end of an outer handle on an opening side of a vehicle door, for example, a coupling arm that is coupled to a latch mechanism is provided at an end on a base member side of the outer handle, and the latch mechanism is disposed in a vehicle door. Furthermore, a fixed receiving portion abuts against this coupling arm. At this time, if the receiving portion is provided in the base member, a large load is applied to the base member that is made of a resin. In addition, if a dedicated metallic receiving member that has the receiving portion is attached to an outer panel, the number of components is increased.

One object of the present disclosure is to provide an outer handle device for a vehicle door that can restrict a turning end of an outer handle to an opening side of the vehicle door while an increase in the number of components is avoided.

An outer handle device for a vehicle door according to one embodiment of the present disclosure (this outer handle device) includes: a latch mechanism; an outer handle having a grip that is arranged on an outer side of an outer panel of a vehicle door and has one end turnably supported by the outer panel, and a coupling arm that is consecutively provided at the other end of the grip and is coupled to the latch mechanism; a base member that is made of a synthetic resin and arranged on the outer side of the outer panel; a metallic reinforcing plate that is interposed between the base member and an outer surface of the outer panel; a cylinder lock configured to switch between locked and unlocked states of the vehicle door, that has a cylinder body fastened to the outer panel by joint fastening with the reinforcing plate and the base member and is disposed in the base member, and a receiving portion that is provided in the reinforcing plate and abuts against the coupling arm during a turning operation of the outer handle to an opening side of the vehicle door to restrict a turning end of the outer handle.

According to this outer handle device, the receiving portion abuts against the coupling arm during turning of the outer handle to the opening side of the vehicle door, and thereby restricts the turning end of the outer handle. In this outer handle device, this receiving portion is provided in the reinforcing plate. Thus, the turning end of the outer handle can be restricted during the turning of the outer handle to the opening side of the vehicle door while the increase in the number of components is avoided.

This outer handle device for the vehicle door may further include: a sheet-like seal member with plural engaging holes that is interposed between the reinforcing plate and the outer surface of the outer panel in a manner to hold the reinforcing plate together with the base member; and plural projections that are provided in the base member in a projected manner and penetrate the reinforcing plate. The plural projections may be respectively and detachably engaged with the engaging holes of the seal member such that the reinforcing plate is temporarily held by the base member.

According to this configuration, the reinforcing plate can be temporarily held by the base member. Thus, work for assembling the reinforcing plate with the receiving portion to the outer panel can be facilitated, and assembling man-hours can be reduced.

Figure 2:
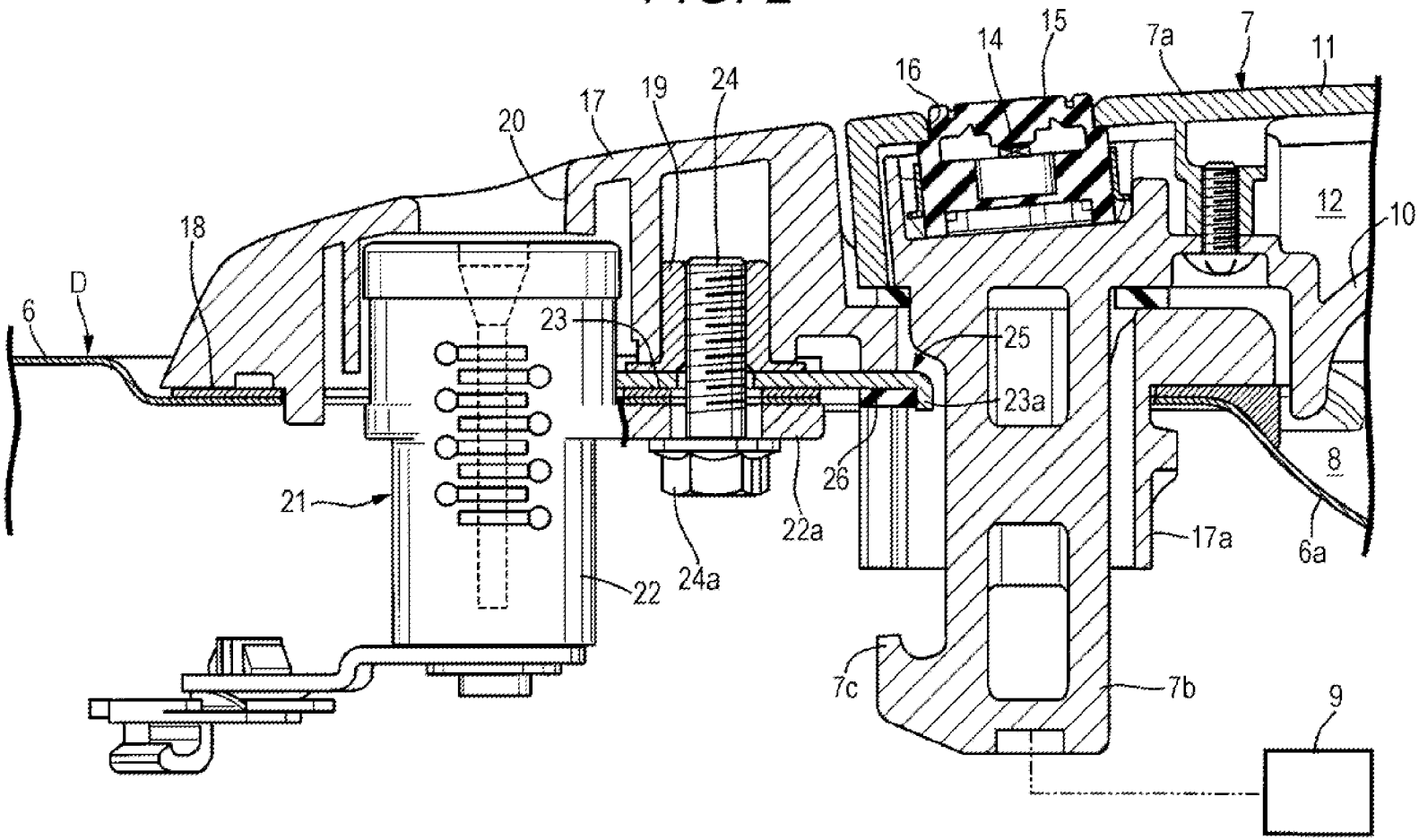
FIG. 2 is a cross-sectional view taken along 2-2 line in FIG. 1.

A description will hereinafter be made on an embodiment of the present disclosure with reference to accompanying FIGS. 1 to 3. A vehicle door D depicted in FIGS. 1 and 2 is a side door, for example. An outer handle 7 that extends in a longitudinal direction (a right and left direction in FIGS. 1 and 2) of a vehicle is turnably attached to an outer panel 6 of the vehicle door D. In this embodiment, the right side in FIGS. 1 and 2 is a front side, and the left side thereof is a rear side.

The outer handle 7 is operated on an outer surface side of the vehicle door D. This outer handle 7 has a grip 7*a* and a coupling arm 7*b*. The grip 7*a* is arranged on an outer side of the outer panel 6 provided in the vehicle door D. An end (a front end in this embodiment) of the grip 7*a* is turnably supported by the outer panel 6. The coupling arm 7*b* is consecutively provided at the other end (a rear end in this embodiment) of the grip 7*a*. The coupling arm 7*b* is coupled to a latch mechanism 9. The outer panel 6 is provided with a curved portion 6*a* for forming a dent 8 in a manner to bulge to an inner side in a vehicle width direction. The dent 8 is provided to allow a vehicle user who grips the grip 7*a* to insert his/her hand between the outer handle 7 and the outer panel 6.

The outer handle 7 includes a handle body 10 and a handle cover 11 made of a synthetic resin. The handle body 10 has an accommodating recess 12 that is opened to an opposite side of the vehicle door D. The handle body 10 is formed of a hard synthetic resin. The handle body 10 extends in the longitudinal direction of the vehicle. The handle cover 11 is fastened to the handle body 10 in a manner to cover the accommodating recess 12 from the opposite side of the vehicle door D. The grip 7*a* contains a part of the handle body 10 and the handle cover 11. The coupling arm 7*b* is integrally formed with the handle body 10.

At the rear of the dent 8, the coupling arm 7*b* penetrates the outer panel 6 and is inserted in the vehicle door D. When the vehicle door D is in an unlocked state, the vehicle user operates the outer handle 7 in a direction to pull the coupling arm 7*b* to the outer side of the vehicle door D. In this way, the latch mechanism 9 cancels a closed state of the vehicle door D. Accordingly, the vehicle user can open the vehicle door D by operating the outer handle 7. The outer handle 7 is urged by an urging member, which is not depicted, such that the coupling arm 7*b* is drawn to the inner side of the vehicle door D.

On the other end side of the grip 7*a*, a tactile switch 14 is disposed in the handle body 10. This tactile switch 14 is accommodated in the accommodating recess 12. This tactile switch 14 is a member for confirming the vehicle user's intention of locking the vehicle door D. The handle cover 11 is provided with an opening 16. It is possible from this opening 16 to see a switch button 15 for operatively pressing the tactile switch 14.

Figure 3:
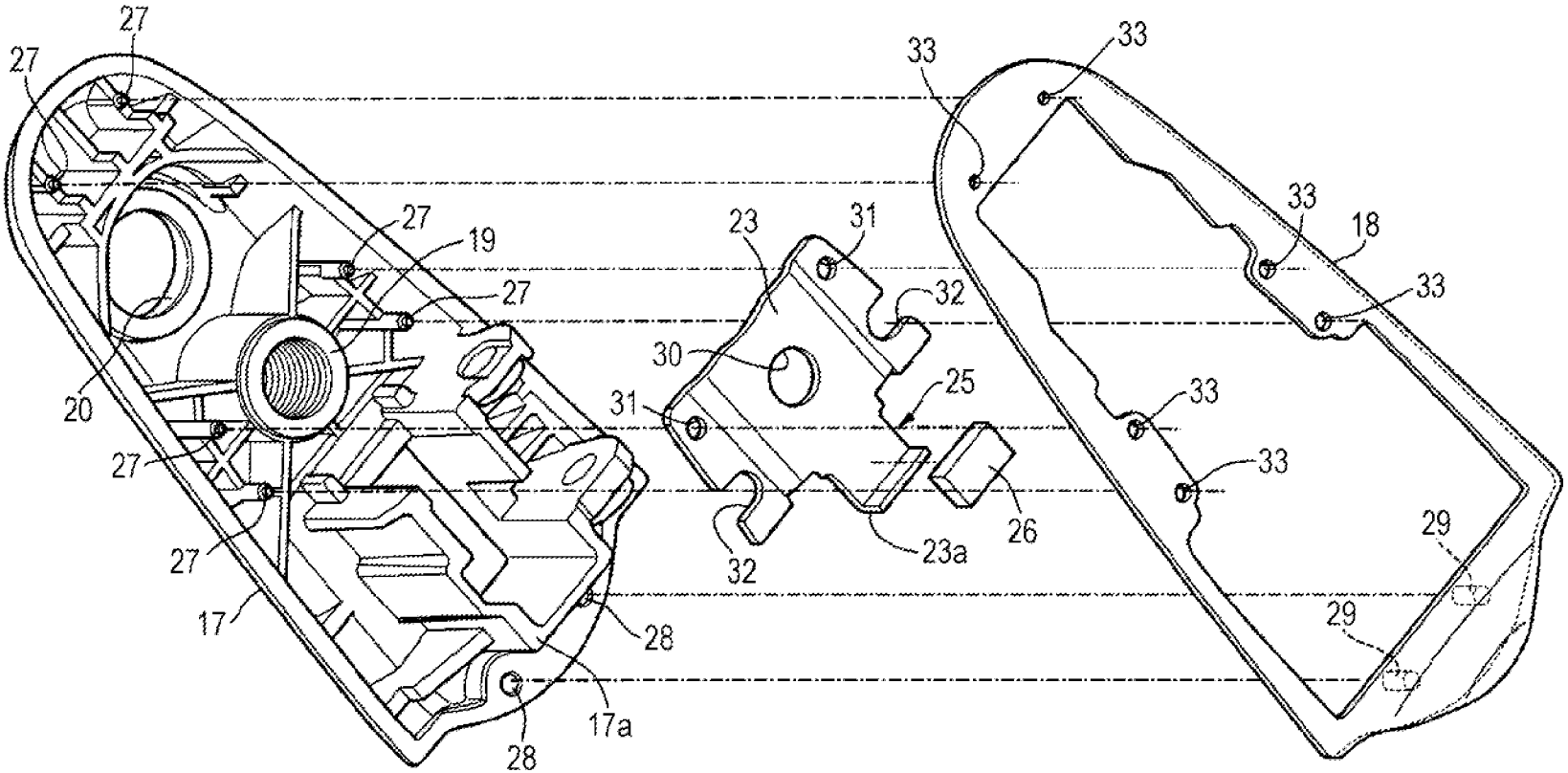
FIG. 3 is an exploded perspective view of a base member, a reinforcing plate, and a seal member.

Also referring to FIG. 3, a base member 17 is arranged at the rear of the outer handle 7. For example, the base member 17 is formed of a hard synthetic resin. The base member 17 is projected to the outer side from the outer panel 6 in a manner to smoothly continue with the other end of the grip 7*a* when the outer handle 7 is in a non-operated state. A seal member 18 is interposed between the base member 17 and an outer surface of the outer panel 6.

In a front portion of the base member 17, a guide cylinder portion 17*a* is integrally provided in the base member 17. At the rear of the dent 8, the guide cylinder portion 17*a* penetrates the outer panel 6 and extends to the inner side of the outer panel 6. The coupling arm 7*b* of the outer handle 7 is inserted through the guide cylinder portion 17*a*. In addition, at the rear of the guide cylinder portion 17*a*, a nut 19 is press-fitted and fixed to the base member 17.

A cylinder lock 21 is disposed in the base member 17 such that the nut 19 is held between the cylinder lock 21 and the guide cylinder portion 17*a*. Locking and unlocking operations are performed on the cylinder lock 21 by a key (not depicted) that is inserted in a key insertion hole 20 provided in the base member 17.

A metallic reinforcing plate 23 is interposed between the base member 17 and the outer surface of the outer panel 6 such that a part of the seal member 18 is held between the reinforcing plate 23 and the outer surface of the outer panel 6. The cylinder lock 21 has a cylinder body 22. This cylinder body 22 is fastened to the outer panel 6 by joint fastening with the reinforcing plate 23 and the base member 17.

More specifically, an attachment arm 22*a* is provided in the cylinder body 22 in an integrated manner with the cylinder body 22. The attachment arm 22*a* extends to the nut 19 side and abuts against an inner surface of the outer panel 6. A bolt 24 with an enlarged-diameter head 24*a* that abuts against and is engaged with this attachment arm 22*a* penetrates the attachment arm 22*a*, the outer panel 6, the seal member 18, and the reinforcing plate 23, and is screwed to the nut 19 that is fixed to the base member 17. When this bolt 24 is fastened, the cylinder body 22 is fastened to the outer panel 6 by the joint fastening with the reinforcing plate 23 and the base member 17.

At a tip of the coupling arm 7*b* of the outer handle 7, a restricting projection 7*c* is integrally provided in the coupling arm 7*b* in a projected manner. A receiving portion 25 is provided in a front portion of the reinforcing plate 23. The receiving portion 25 abuts against the restricting projection 7*c* during a turning operation of the outer handle 7 to an opening side of the vehicle door D, and thereby restricts a turning end of the outer handle 7.

In this embodiment, the receiving portion 25 has a bent portion 23*a* and a plate-shaped elastic piece 26. The bent portion 23*a* is bent in a substantially L shape and is formed in the front portion of the reinforcing plate 23 in an integrated manner with the reinforcing plate 23. The elastic piece 26 is adhered to the bent portion 23*a*. The restricting projection 7*c* abuts against this elastic piece 26.

As depicted in FIG. 3, at plural positions on a peripheral edge of an inner surface of the base member 17 that faces the outer panel 6 side, projections 27 are integrally provided in the base member 17 in a manner to be projected to the outer panel 6 side. In a front portion of the inner surface of the base member 17 that faces the outer panel 6 side, a pair of positioning recesses 28 is provided with a space being interposed therebetween in a vertical direction.

In the reinforcing plate 23 with an insertion hole 30, through which the bolt 24 is inserted, a pair of through holes 31 and a pair of recesses 32 are provided in a manner to penetrate both of upper and lower sides of the reinforcing plate 23. A pair of the projections 27 among the plural projections 27 is inserted through the pair of through holes 31. Another pair of the projections 27 among the plural projections 27 is inserted through the pair of recesses 32.

The seal member 18 is provided with plural engaging holes 33. The projections 27 of the base member 17 are respectively and detachably engaged with the engaging holes 33. Furthermore, in the seal member 18, a pair of fitted projections 29 is integrally provided in the seal member 18 in a projected manner. The fitted projections 29 are respectively and detachably fitted to the positioning recesses 28 of the base member 17.

As described above, the four projections 27 that penetrate the reinforcing plate 23 are provided in the base member 17 in the projected manner. The reinforcing plate 23 is held between the seal member 18 and the base member 17. Accordingly, when the four projections 27 of the base member 17 are engaged with the four engaging holes 33 of the seal member 18, the reinforcing plate 23 can be temporarily held by the base member 17.

Note that the reinforcing plate 23 is fastened to the outer panel 6 by the joint fastening with the cylinder body 22 and the base member 17 with use of the bolt 24. That the reinforcing plate 23 is temporarily held by the base member 17 means, for example, that the reinforcing plate 23 is held by (fixed to) the base member 17 (and the seal member 18) before being fastened by the bolt 24.

Next, effects of this embodiment will be described. In this embodiment, the metallic reinforcing plate 23 is interposed between the base member 17 and the outer surface of the outer panel 6. The base member 17, which is made of the synthetic resin, and the metallic reinforcing plate 23 are fastened to the outer panel 6 by the joint fastening with the cylinder body 22 of the cylinder lock 21. The reinforcing plate 23 is provided with the receiving portion 25. This receiving portion 25 abuts against the coupling arm 7*b* (the restricting projection 7*c*) of the outer handle 7 during the turning operation of the outer handle 7 to the opening side of the vehicle door D, and thereby restricts the turning end of the outer handle 7. Accordingly, the turning end of the outer handle 7 can be restricted during the turning of the outer handle 7 to the opening side of the vehicle door D while an increase in the number of components is avoided.

In addition, the metallic reinforcing plate 23 is interposed between the base member 17 and the outer surface of the outer panel 6. The sheet-like seal member 18 with the plural engaging holes 33 is interposed between the reinforcing plate 23 and the outer surface of the outer panel 6 in a manner to hold the reinforcing plate 23 together with the base member 17. The plural projections 27 that penetrate the reinforcing plate 23 are provided in the base member 17 in the projected manner. The projections 27 of the base member 17 are respectively and detachably engaged with the engaging holes 33 of the seal member 18 such that the reinforcing plate 23 is temporarily held by the base member 17. Accordingly, work for assembling the reinforcing plate 23 with the receiving portion 25 to the outer panel 6 can be facilitated, and assembling man-hours can be reduced.

Note that an excessive load is possibly applied to an attachment portion of the cylinder lock 21 to the base member 17 by illicit attack on the cylinder lock 21. In this embodiment, the metallic reinforcing plate 23 is interposed between the base member 17, which is made of the synthetic resin, and the outer surface of the outer panel 6. The cylinder body 22 of the cylinder lock 21 is fastened to the outer panel 6 by the joint fastening with the reinforcing plate 23 and the base member 17. Accordingly, attachment strength of the base member 17 and the cylinder lock 21 to the outer panel 6 can be increased.

The description has been made so far on the embodiment of the present disclosure. A technique of the present disclosure is not limited to the above embodiment. Various modifications can be made to the design of the embodiment of the present disclosure without departing from the scope of the claims.

In this embodiment, the base member 17 is provided with the two pairs of the projections 27. Furthermore, the seal member 18 is provided with the four engaging holes 33. The number and positions of the projections 27 in the base member 17 and the number and positions of the engaging holes 33 in the seal member 18 can be arbitrary number and positions as long as the projections 27 are respectively and detachably engaged with the engaging holes 33.

In this embodiment, the base member 17 is provided with the pair of the positioning recesses 28, and the seal member 18 is provided with the pair of the fitted projections 29. The number and the positions of the positioning recesses 28 in the base member 17 and the number and the positions of the fitted projections 29 in the seal member 18 can be the arbitrary member and positions as long as the fitted projections 29 respectively and detachably fitted to the positioning recesses 28.

In this embodiment, the base member 17 is projected to the outer side from the outer panel 6 in a manner to smoothly continue with the other end of the grip 7*a* when the outer handle 7 is in the non-operated state. However, the base member 17 may not be provided in a manner to smoothly continue with the other end of the grip 7*a* when the outer handle 7 is in the non-operated state. The base member 17 only needs to be arranged on the outer side of the outer panel 6.

It can be said that this embodiment relates to an outer handle device for a vehicle door that includes: an outer handle, one end of which is turnably supported by an outer panel provided in the vehicle door, and, in which a coupling arm is consecutively provided at the other end of a grip arranged on an outer side of the outer panel, the coupling arm being coupled to a latch mechanism a base member that is made of a synthetic resin and arranged on the outer side of the outer panel in a manner to continue with the other end of the grip when the outer handle is in a non-operated state; a metallic reinforcing plate that is interposed between the base member and the outer panel; and a cylinder lock that has a cylinder body fastened to the outer panel by joint fastening with the reinforcing plate and the base member and is disposed in the base member so as to switch between locked and unlocked states of the vehicle door.

The embodiment of the present disclosure may be the first and second outer handle devices for a vehicle door, which will be described below.

The first outer handle device for the vehicle door is an outer handle device for the vehicle door including: an outer handle (7), one end of which is turnably supported by an outer panel (6) provided in the vehicle door (D), and, in which a coupling arm (7*b*) is consecutively provided at the other end of a grip (7*a*) arranged on the outer side of the outer panel (6), the coupling arm (7*b*) being coupled to a latch mechanism (9); a base member (17) that is made of a synthetic resin and arranged on the outer side of the outer panel (6) in a manner to continue with the other end of the grip (7*a*) when the outer handle (7) is in a non-operated state; a metallic reinforcing plate (23) that is interposed between the base member (17) and an outer surface of the outer panel (6); and a cylinder lock (21) that has a cylinder body (22) fastened to the outer panel (6) by joint fastening with the reinforcing plate (23) and the base member (17) and is disposed in the base member (17) so as to switch between locked and unlocked states of the vehicle door (D). The reinforcing plate (23) is provided with a receiving portion (25) that abuts against the coupling arm (7*b*) during a turning operation of the outer handle (7) to an opening side of the vehicle door (D) and thereby restricts a turning end of the outer handle (7).

In the second outer handle device for the vehicle door according to the first outer handle device for the vehicle door, a sheet-like seal member (18) with plural engaging holes (33) is interposed between the reinforcing plate (23) and the outer surface of the outer panel (6). Plural projections (27) that is provided in the base member (17) in a projected manner and penetrate the reinforcing plate (23) are respectively and detachably engaged with the engaging holes (33) of the seal member (18) for holding the reinforcing plate (23) between the base member (17) and the seal member (18) such that the reinforcing plate (23) is temporarily held by the base member (17).

According to the first outer handle device for the vehicle door, the reinforcing plate is provided with the receiving portion that can abut against the coupling arm and thereby restricts the turning end of the outer handle to the opening side of the vehicle door. Thus, the turning end of the outer handle to the opening side of the vehicle door can be restricted while the increase in the number of components is avoided.

According to the second outer handle device for the vehicle door, the reinforcing plate can be temporarily held by the base member. Thus, the assembling work to the outer panel can be facilitated, and the assembling man-hours can be reduced.

The foregoing detailed description has been presented for the purposes of illustration and description. Many modifications and variations are possible in light of the above teaching.

It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. An outer handle device for a vehicle door comprising:

a latch mechanism;

an outer handle having a grip that is arranged on an outer side of an outer panel of a vehicle door and has one end turnably supported by the outer panel, and a coupling arm that is provided at the other end of the grip and is coupled to the latch mechanism;

a base member that is made of a synthetic resin and arranged on the outer side of the outer panel;

a metallic reinforcing plate that is interposed between the base member and an outer surface of the outer panel;

a cylinder lock configured to switch between locked and unlocked states of the vehicle door, that has a cylinder body fastened to the outer panel by joint fastening with the reinforcing plate and the base member and is disposed in the base member; and a receiving portion that is provided in the reinforcing plate and abuts against the coupling arm during a turning operation of the outer handle to an opening side of the vehicle door to restrict a turning end of the outer handle.

2. The outer handle device for the vehicle door according to claim 1, wherein the base member is arranged on the outer side of the outer panel in a manner to continue with the other end of the grip when the outer handle is in a non-operated state.

3. The outer handle device for the vehicle door according to claim 1 further comprising:

a sheet-like seal member with plural engaging holes that is interposed between the reinforcing plate and the outer surface of the outer panel in a manner to hold the reinforcing plate together with the base member; and plural projections that are provided in the base member in a projected manner and penetrate the reinforcing plate, wherein the plural projections are respectively and detachably engaged with the engaging holes of the seal member such that the reinforcing plate is temporarily held by the base member.

4. The outer handle device for the vehicle door according to claim 3, wherein the base member includes a positioning recess in an inner surface of the base member that faces an outer side of the outer panel, and the seal member includes a fitted projection that is detachably fitted to the positioning recess of the base member.

5. The outer handle device for the vehicle door according to claim 1, further comprising a plate-shaped elastic piece that is adhered to the receiving portion, wherein the outer handle comprises a restricting projection, and the restricting projection abuts against the elastic piece during the turning operation of the outer handle to the opening side of the vehicle door.

* * * * *